United States Patent [19]

Skinner

[11] Patent Number: 4,467,965

[45] Date of Patent: Aug. 28, 1984

[54] FUEL INJECTION NOZZLES

[75] Inventor: Robert T. J. Skinner, High Wycombe, England

[73] Assignee: Lucas Industries Public Limited Company, Birmingham, England

[21] Appl. No.: 487,152

[22] Filed: Apr. 21, 1983

[30] Foreign Application Priority Data

Jun. 19, 1982 [GB] United Kingdom ..... 8217830

[51] Int. Cl.[3] ..... B05B 1/34

[52] U.S. Cl. ..... 239/464; 239/533.12; 239/563

[58] Field of Search ..... 239/464, 533.2–533.12, 239/563, 406

[56] References Cited

U.S. PATENT DOCUMENTS

| | | | |
|---|---|---|---|
| 1,451,063 | 4/1923 | Anthony | 239/406 |
| 4,168,804 | 9/1979 | Hofmann | 239/533.11 |
| 4,339,080 | 7/1982 | Kopse | 239/533.3 |

FOREIGN PATENT DOCUMENTS

| | | | |
|---|---|---|---|
| 406956 | 3/1934 | United Kingdom | 239/533.2 |
| 506609 | 6/1939 | United Kingdom | 239/533.2 |
| 2034405 | 6/1980 | United Kingdom | 239/533.2 |

*Primary Examiner*—John J. Love
*Assistant Examiner*—Jon M. Rastello

[57] ABSTRACT

A fuel injection nozzle for supplying fuel to a compression ignition engine includes a valve member slidable within a bore, a seating in the bore and the valve member being shaped to co-operate with the seating. An extension is carried by the valve member and is slidable in a guide bore extending from the seating to the exterior of the nozzle. The extension has an outlet chamber into which opens a first passage through which fuel can flow as soon as the valve member is lifted from the seating and a second passage through which fuel can flow with increasing quantity as the valve member lifts from the seating. The first passage causes swirling of fuel in the chamber and produces a bushy fuel spray and the fuel flowing through the second passage progressively cancels the swirling to produce a penetrative jet of fuel.

4 Claims, 5 Drawing Figures

FUEL INJECTION NOZZLES

This invention relates to a fuel injection nozzle for supplying fuel to a combustion chamber of a compression ignition engine, the nozzle being of the kind comprising a bore, a seating defined in the bore and a valve member shaped for co-operation with the seating and movable away from the seating by the action of fuel under pressure supplied to the bore, to allow fuel flow through an outlet.

In order to improve the process of combustion of fuel in the combustion chamber it has been proposed to direct a highly penetrative jet of fuel from the nozzle into the combustion chamber. At low engine speeds and low engine loads where small quantities of fuel are to be delivered, it has been found desirable to arrange that instead of a jet of fuel, the fuel spray pattern produced by the nozzle is of bushy form.

The object of the invention is to provide a fuel injection nozzle of the kind specified in a simple and convenient form.

According to the invention, a fuel injection nozzle of the kind specified comprises a guide bore extending from said seating to the exterior of the nozzle, an extension on said valve member, said extension being slidable within said guide bore, a chamber defined in said extension, said chamber having an open end defining the outlet to the exterior of the nozzle, a first flow passage in the extension, said first flow passage opening into said chamber at a position so that fuel flowing therethrough when the valve member is lifted from its seating will swirl in one direction in said chamber, thereby to cause the fuel spray leaving said outlet to be of bushy form, and a second flow passage in the extension, said second flow passage being arranged to be progressively uncovered as the valve member moves away from the seating, said second flow passage being disposed so that fuel flowing therethrough cancels the swirl produced by the first flow passage thereby to cause the fuel to leave said outlet in the form of a jet.

Examples of fuel injection nozzles in accordance with the invention will now be described with reference to the accompanying drawings in which.

Figure 1:
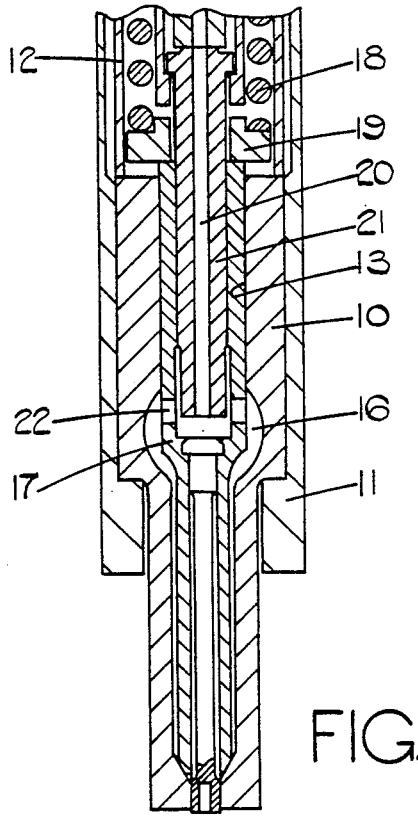
FIG. 1 is a sectional side elevation of part of a fuel injection nozzle in accordance with the invention.

Referring to FIG. 1, the nozzle comprises a body 10 having a stepped peripheral surface which can be engaged by a cap nut 11 to retain the nozzle on a holder 12. The holder 12 defines a fuel inlet for connection in use to a fuel injection pump.

Formed in the body 10 is a bore 13 one end of which opens into a chamber defined in the holder and the other end of which defines a seating 14 of truncated conical form. A guide bore 15 of smaller diameter than the bore 13, extends from the seating to the exterior of the nozzle. Intermediate its ends the bore is provided with an enlargement 16, this defining a chamber to which fuel under pressure is supplied from the aforesaid fuel inlet by way of a passage.

Slidable within the bore 13 is a valve member 17 which is guided for movement by that portion of the bore 13 between the enlargement 16 and the chamber defined in the holder. The valve member extends with clearance in the portion of the bore between the enlargement 16 and the seating 14 and it is shaped at its end, to co-operate with the seating 14. Moreover, the valve member is urged into contact with the seating by means of a coiled compression spring 18 housed within the chamber in the holder, and acting upon the valve member by way of a spring abutment 19.

Conveniently, the aforesaid enlargement 16 communicates with the fuel inlet by way of a passage 20 which is formed in a central fixed stem 21 slidable within a bore formed in the valve member. The end of the bore communicates with the enlargement 16 by way of ports 22 formed in the valve member. The fuel inlet may communicate with the enlargement by way of a passage formed in the body 10 as is well known in the art.

Figure 2:
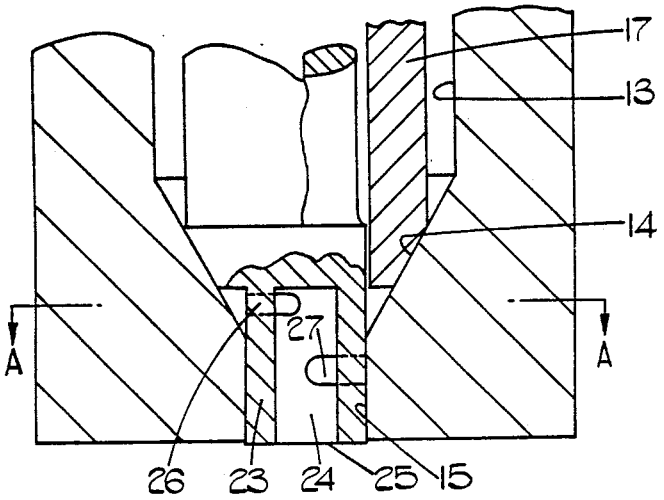
FIG. 2 shows to an enlarged scale part of the nozzle shown in FIG. 1 and also shows an alternative construction.

As shown in the left hand portion of FIG. 2, the valve member defines a cylindrical extension 23 which is slidably located within the guide bore 15. Formed in the extension is an open ended cylindrical chamber 24, the open end of which defines a fuel outlet 25. As shown in FIGS. 1 and the right hand portion of FIG. 2, the extension 23 is formed on a separate part carried by the main portion of the valve member in such a manner as to permit slight flexibility of movement in order to reduce the cost of manufacturing the nozzle. The valve member is lifted from the seating by the action of fuel under pressure in the chamber defined by the enlargement 16.

Figure 4:
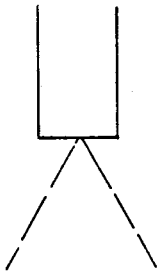
FIGS. 4 and 5 are diagrammatic views showing the spray pattern produced by the nozzles.

Opening into the chamber 24 is a first passage 26 and this passage is tangentially disposed relative to the chamber. Moreover, the opening of the passage 26 is not obturated by the guide bore 15 so that, as soon as the guide member is lifted from its seating by the pressure of fuel acting on the valve member, fuel can flow through the passage 26 and the flow of fuel causes swirling of the fuel within the chamber. The swirling motion results in the fuel leaving the opening 25 to form a bushy spray which has a low penetrative power. This spray is diagrammatically shown in FIG. 4.

Figure 3:
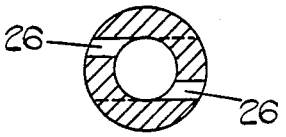
FIG. 3 is a section on the line A—A of FIG. 2.
Figure 5:
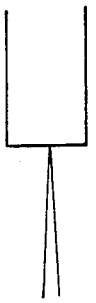

Also opening into the chamber is a further passage 27. This passage is positioned so that its opening is obturated by the wall of the guide bore 15 until the valve member has moved a predetermined extent against the action of the spring. As such valve movement takes place, the opening of the passage 27 is progressively uncovered. The passage 27 is also tangentially disposed relative to the chamber but in the opposite direction so that as fuel starts to flow through the passage 27, it counteracts the swirling of the fuel in the chamber due to the action of the passage 26. It is arranged that the swirl is exactly counteracted when the valve member is fully open and the fuel leaves the outlet 25 as a highly penetrative jet. The spray pattern therefore gradually changes as the passage 27 is uncovered, from the pattern shown in FIG. 4, to that shown in FIG. 5. As shown in FIG. 3, two passages 26 may be provided and a similar number of passages 27 can also be provided.

The discharge coefficient when only the passages 26 are supplying fuel to the chamber, is relatively low but when the passages 27 are brought into operation the discharge coefficient may be 2–3 times greater.

I claim:

1. A fuel injection nozzle for supplying fuel to a combustion chamber of a compression ignition engine, comprising a bore, a seating defined in the bore and a valve member shaped for co-operation with the seating and movable away from the seating by the action of fuel under pressure supplied to the bore, to allow fuel flow through an outlet, a guide bore extending from said seating to the exterior of the nozzle, an extension on said valve member, said extension being slidable within said guide bore, a chamber defined in said extension, said chamber having an open end defining the outlet to the exterior of the nozzle, a first flow passage in the extension, said first flow passage opening into said chamber at a position so that fuel flowing therethrough when the valve member is lifted from its seating will swirl in one direction in said chamber, thereby to cause the fuel spray leaving said outlet to be of bushy form, and a second flow passage in the extension, said second flow passage being arranged to be progressively uncovered as the valve member moves away from the seating, said second flow passage being disposed so that fuel flowing therethrough cancels the swirl produced by the first flow passage thereby to cause the fuel to leave said outlet in the form of a jet.

2. A nozzle according to claim 1 in which said flow passages are tangentially disposed.

3. A nozzle according to claim 1 in which said extension is formed integrally with the valve member.

4. A nozzle according to claim 1 in which said extension is formed on a part carried by the valve member.

* * * * *